United States Patent [19]

Agnew et al.

[11] 4,200,404

[45] Apr. 29, 1980

[54] LOOSE LEAF BINDERS

[76] Inventors: Kenneth M. Agnew, 10 Chesterfield Rd., London W4; Charles H. P. Denroche, 90 Park Rd., Hampton Wick, Kingston-upon-Thames, Surrey; Roy Hewlett, 46 Lytton Grove, London SW15, all of England

[21] Appl. No.: 943,862

[22] Filed: Sep. 19, 1978

Related U.S. Application Data

[60] Continuation of Ser. No. 748,891, Dec. 9, 1976, abandoned, which is a division of Ser. No. 467,363, May 6, 1974, Pat. No. 4,000,951.

[30] Foreign Application Priority Data

May 8, 1973 [GB] United Kingdom ..... 21950/73

[51] Int. Cl.[2] ..... B42F 13/14

[52] U.S. Cl. ..... 402/22; 24/211 M; 402/63; 402/68; 402/80 P

[58] Field of Search ..... 402/8, 14, 15, 19–23, 402/26, 29, 42, 45, 47, 60, 61, 63, 68, 70, 71, 73, 74, 75, 80 R, 80 P; 24/16 PB, 211 R, 211 M, 224; 16/DIG. 13; 281/17; 85/7, 5 M

[56] References Cited

U.S. PATENT DOCUMENTS

| | | | |
|---|---|---|---|
| 1,302,918 | 5/1919 | Harris | 24/224 |
| 1,463,949 | 8/1923 | Gerber | 24/224 |
| 2,109,520 | 3/1938 | Awbrey | 85/7 |
| 2,193,802 | 3/1940 | Chambless et al. | 24/224 |
| 3,087,498 | 4/1963 | Vogel | 402/22 |
| 3,260,264 | 7/1966 | McKowen | 402/22 |
| 3,537,146 | 11/1970 | Caveney | 24/16 PB |
| 3,768,838 | 10/1973 | Shibata | 281/17 |
| 4,000,951 | 1/1977 | Agnew et al. | 402/22 |

FOREIGN PATENT DOCUMENTS

| | | | |
|---|---|---|---|
| 1263690 | 3/1968 | Fed. Rep. of Germany | 402/68 |
| 5640 | of 1912 | United Kingdom | 24/224 |
| 1024220 | 3/1966 | United Kingdom | 24/208 A |

*Primary Examiner*—John McQuade
*Attorney, Agent, or Firm*—Blanchard, Flynn, Thiel, Boutell & Tanis

[57] ABSTRACT

A loose leaf binder which can be moulded as an integral structure from resilient plastics, e.g. polypropylene has posts which lie in openings in a side portiion of the binder and are pivotable into the upright position. Projections on the posts or the side portion adjacent the pivotal connection serve to maintain the posts releasably in the upright position. The free ends of the posts are engageable in openings in the other side portion and movable locking members are provided to positively lock the ends of the posts in these openings.

13 Claims, 5 Drawing Figures

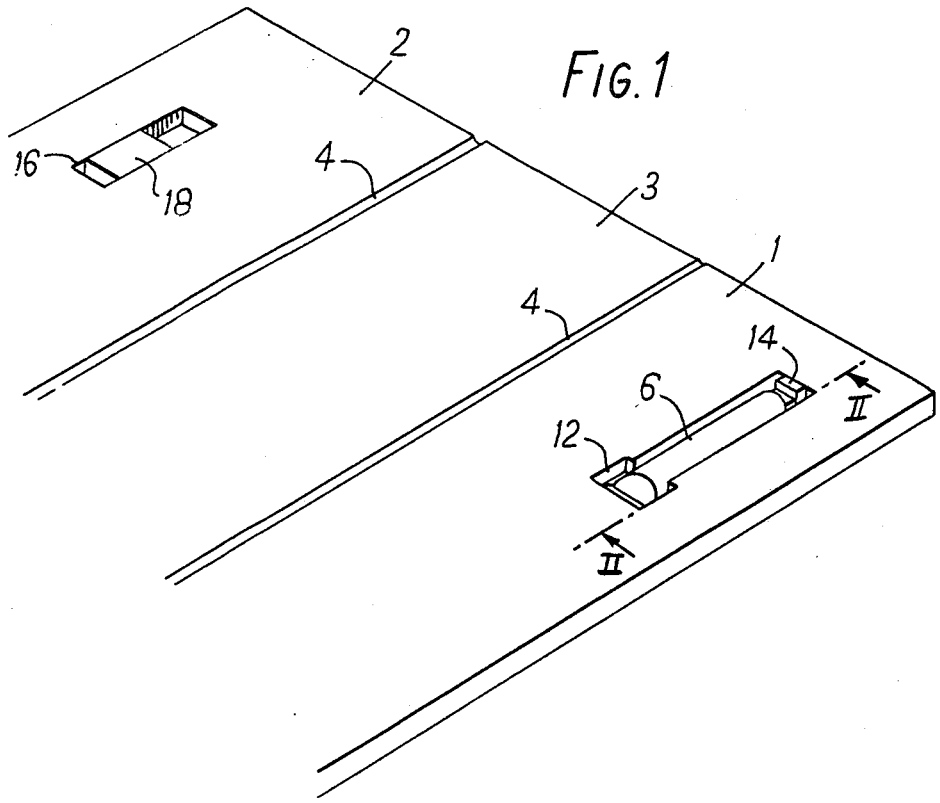
FIG. 1
FIG. 4
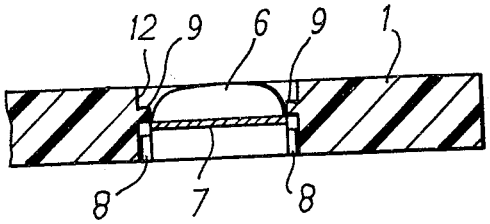

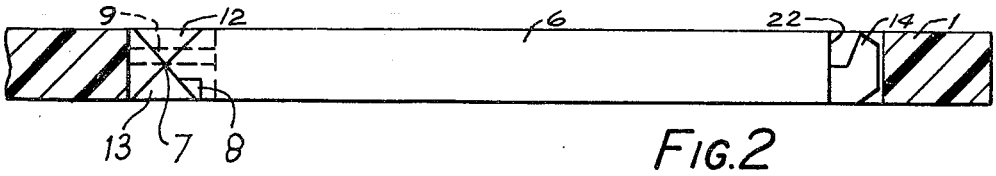
FIG. 2
FIG. 3
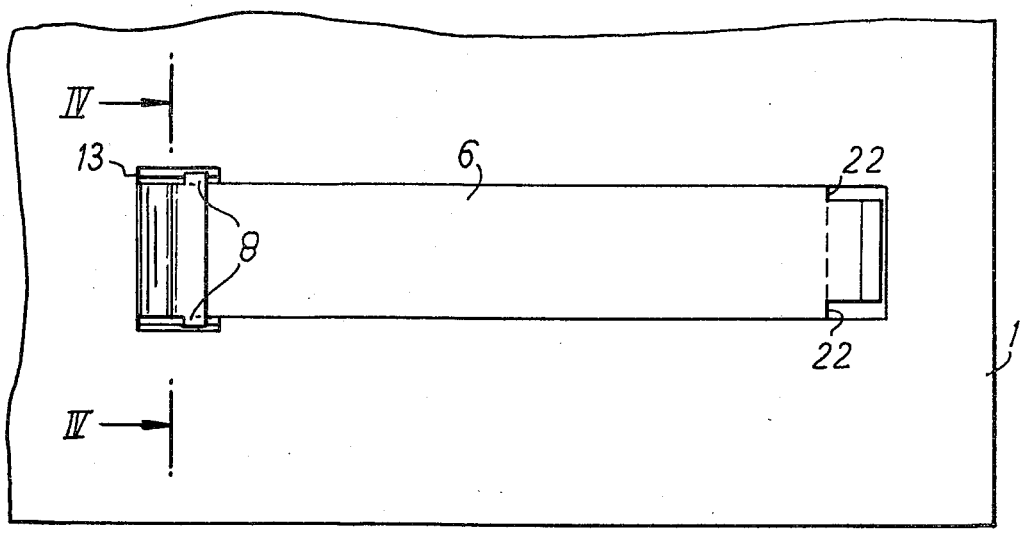
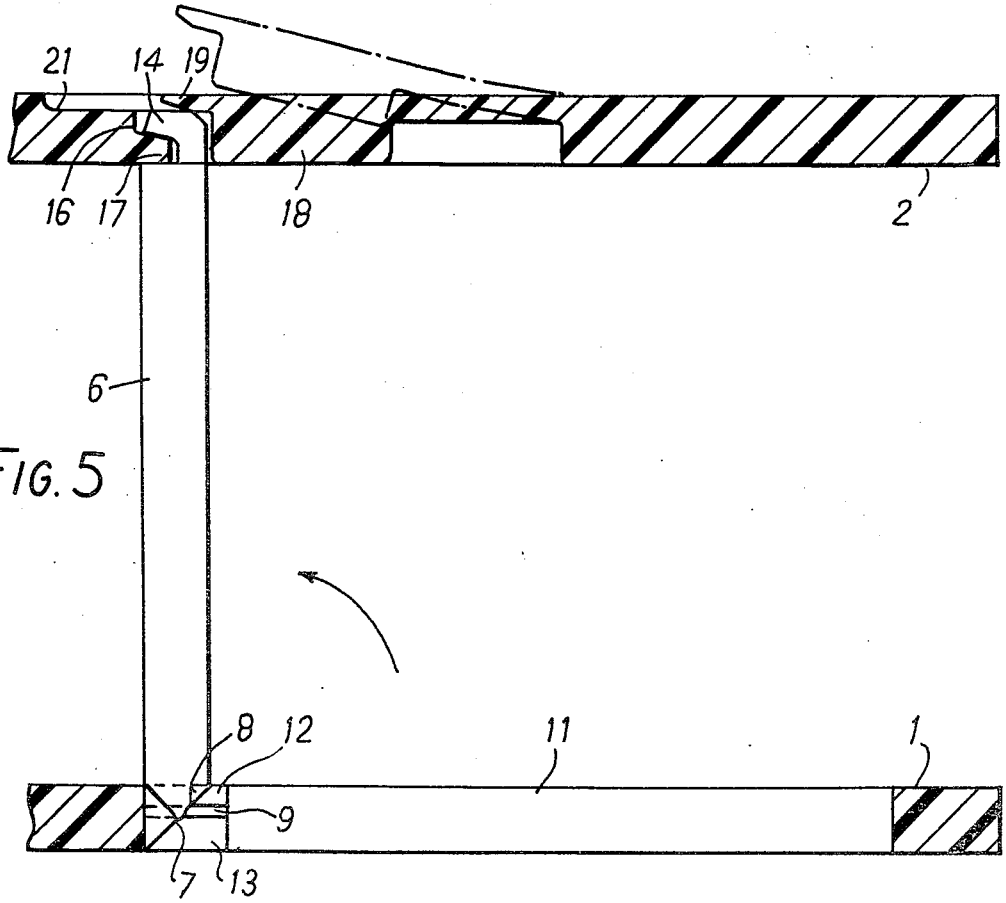
FIG. 5

LOOSE LEAF BINDERS

This is a continuation of application Ser. No. 748,891, filed Dec. 9, 1976, now abandoned, which in turn was a division of application Ser. No. 467,363, filed May 6, 1974, now U.S. Pat. No. 4,000,951.

The present invention relates to improvements in loose leaf binders.

Generally, the invention relates to a loose leaf binder having two side portions for placing on either side of a sheaf of paper or other material to be bound, one of the side portions having a post for passing through a hole in the papers and coupling releasably with the other side portion.

In an advantageous embodiment of the invention, the binder is formed as an integral structure of moulded resiliently deformable plastics material. The post of the binder is arranged to be pivotable. This has the advantage that the binder can be injection-moulded in a flat condition, with the post positioned in the plane of one of the side portions. Preferably, the other side portion has means for coupling releasably with the free end of the post. In the most convenient forms of the binder, the post will be laterally immovable relative to the said one side portion.

The said other side portion may have a movable locking member adapted to positively lock the free end of the post releasably in engagement therewith.

In the preferred form, the positive locking is provided by the post having at its free end a shoulder which can engage with a side surface of an opening in the other side portion, and the movable member is adapted to releasably hold the shoulder in engagement with the surface. In the locking position, the movable member may be adjacent the side of the post opposite to the side having the shoulder thereon.

A number of posts may be provided on a single side portion, the posts conveniently being spaced apart at conventional punch-hole spacings.

In order to maintain the posts in the upright position after they have been pivoted out of the plane of the side portion, the posts and/or the side portion may be provided with one or more projections near their points of pivotal connection, the projections engaging with cooperating surfaces when the posts are pivoted upwardly.

A loose leaf binder in accordance with the invention will now be described, by way of example only, with reference to the accompanying drawings in which:

FIG. 1 shows in perspective a loose leaf binder accoring to the invention;

FIG. 2 shows the binder in section along the line II—II in FIG. 1;

FIG. 3 shows a view from the underside of the binder of FIG. 1;

FIG. 4 shows the binder in section along the lines IV—IV of FIG. 3; and

FIG. 5 shows the binder with the post in the upright position coupled with the other side portion.

Referring to the drawings, the binder comprises two side portions 1 and 2, respectively, hinged on opposite edges of a back portion 3. Grooves 4 are formed on the inner face of the binder between each side portion 1 and 2 and the back portion 3. The grooves 4 constitute hinge lines about which the side portions 1 and 2 can be pivoted upwardly towards one another to close the binder and provide a channel for receiving the edges of the papers to be bound.

A post 6, for passing through punch-holes in the papers to be bound, is formed integrally with the said one side portion 1. The post 6 is pivotally connected to the side portion 1 by a narrow neck portion 7 so that in use the post 6 can be pivoted from a manufacturing and storage position shown in FIGS. 1 to 4, in which the post 6 lies in the plane of the side portion 1, to an upright position shown in FIG. 5.

In order to maintain the post 6 in its upright position, triangular-section projections 8 are provided on the sides of the post 6 near the neck portion 7 and adjacent the outer face of the side portion 1. When the post is pivoted into its upright position, the projections 8 rise above the post's pivotal connection constituted by the neck portion 7 and surfaces thereof facing toward the neck portion 7 engage on the upper surfaces of the ribs 9 which project inwardly from the opposite sides of a slot 11 in which the post is received in the said one side portion 1, and hence return movement of the post 6 to the storage position shown in FIGS. 1 to 4 is resisted.

The opposite faces of the said one side portion 1 each have a recess in the region of the neck portion 7, the two recesses being indicated at 12 and 13, respectively in the drawings, and these recesses accommodate the projections 8 when the post is in the upright and storage positions, respectively.

In order to facilitate movement of the projections 8 past the ribs 9 when erecting the post 6, the projections 8 and the ribs 9 are of resiliently deformable material, e.g. resilient plastics.

After placing loose leaves in the binder, with the post 6 passing through punch holes in the leaves, the free end of the post 6 can be releasably locked in engagement with the other side portion 2, as shown in FIG. 5.

For this purpose, the free end of the post 6 is hooked shaped and provides a transverse projection 14 which can be inserted in a slot 16 in the side portion 2, with the shoulder formed by the under surface of the projection 14 engaging the upper surface of a member 17 which extends from an edge of the slot 16. The locking is effected by a pivotally movable portion 18 on the side portion 2 opposite the edge of the slot 16 having the member 17 thereon. In the locking position shown in solid lines in FIG. 5 the portion 18 resists lateral movement of the projection 14 away from the rim 17 of the slot 16. When locking or unlocking the post 6, the user can pivot the movable portion 18 away from the locking position to the position shown in broken lines in FIG. 5 to allow the free end of the post 6 to be introduced into or disengaged from the slot 16. The locking portion 18 thus moves into and out of the slot 16 by being respectively moved inwardly from or outwardly toward the outer face of the side portion 2, as indicated by the dotted line position in FIG. 5, which is thus the opposite face from which the free end of post 6 is introduced into slot 16. The movable portion 18 is provided with a tab 19, and a recess 21 is formed in outer face of the side portion 2 so that the movable portion 18 can be lifted with the finger.

In the form shown in the drawings, the free end of the post 6 is stepped to provide longitudinal and transverse shoulders 22 at the base of the hook-shaped portion which can engage with the inner face of the side portion 2. The sides of the hook-shaped portion and of the projection 14 may be tapered to facilitate introducing the post 6 into the slot 16.

As shown in the drawings the slot 16 is stepped so that the rim 17 on which the projection 14 engages is offset towards the inner face of the side portion 2. This avoids the post 6 protruding above the outer face of the side portion 2 and gives a neat appearance to the binder when in the closed position.

In the most useful forms of the binder, the side portions 1 and 2 will be provided with a number of sets of posts and locking arrangements, the number of posts and their arrangements being the same as one of the standard punch-hole arrangements for loose leaves.

In the preferred form, the binder described above is moulded is plastics as a unitary structure, e.g. by injection moulding.

It is preferred to employ polypropylene. Other suitable resiliently deformable plastics materials include high-density polyethylene, nylon, reinforced nylon and polyterephthalate.

In the preferred form, the structure shown in the drawings, is moulded in the configuration shown in FIG. 1, that is to say as a substantially flat structure with the posts lying in the plane of the structure. This flat structure is convenient for storage or transport since a number of the binders can be packed flat together and occupy minimum volume.

We claim:

1. A releasable coupling comprising a first member having an opening extending thereinto from a face thereof and a first bearing surface which is at an edge of the opening and faces away from said face, a second member insertable in the opening from the said face with a second bearing surface on the second member for engagement with the first bearing surface, and locking means for preventing said first and second members from being disconnected from one another due to relative movement therebetween, said locking means comprising a locking member forming part of the first member and movable into the opening in a first direction which is opposite to the direction of insertion of said second member to retain the second bearing surface releasably against the first bearing surface, said locking member being movable out of the opening in a direction opposite to said first direction to permit separation between said first and second members, said locking member defining accessible manual engagement means thereon, said locking member when positioned in the opening retaining the first and second bearing surfaces in contact and preventing separation between the first and second members until said locking member is moved manually out of said opening.

2. A coupling according to claim 1 in which the locking member is integral with the first member.

3. A coupling according to claim 1 in which the opening extends wholly through the first member to a face thereof opposite that through which the second member is inserted, and in which the locking member is inserted into the opening from the said opposite face.

4. A coupling according to claim 3 in which the locking member includes a tab portion which lies in said opening adjacent the said opposite face of the first member when the locking member is inserted into the opening, said tab portion defining said manual engagement means and being positioned to overlie a part of said second member when the second member is disposed in said opening and said locking member is positioned within said opening, and said first member having a recess formed in the said opposite face thereof in communication with said opening for providing manual access to said tab portion.

5. A coupling according to claim 1 in which the locking member pivots on an edge of the opening opposite the first-mentioned edge thereof.

6. A coupling according to claim 1 in which the first and second bearing surfaces are oriented so that, when the first member is moved away from the second member with the locking member out of the opening, the said bearing surfaces tend to disengage from one another.

7. A coupling according to claim 1 in which the second member has a free end insertable into the opening and formed with a transversely extending recess, the upper side of which provides the said second bearing surface, the said edge of the opening in the first member being receivable in the recess.

8. A coupling according to claim 1 in which the opening extends wholly through the first member to a face thereof opposite that through which the second member is inserted, in which the locking member is integral with the first member and pivots on an edge of the opening opposite the first-mentioned edge thereof, and in which the locking member is inserted into the opening from the said opposite face.

9. A coupling according to claim 8 in which the second member has a free end insertable into the opening and formed with a transversely extending recess, the upper side of which provides the said second bearing surface, and the first-mentioned edge of the opening in the first member being receivable in the recess for connecting the first and second members together, and said locking member when positioned within the opening preventing the first-mentioned edge of the opening from being withdrawn from the recess so as to prevent separation of the first and second members.

10. A releasable coupling, comprising:

a first platelike member having inner and outer oppositely directed faces, an opening extending through said platelike member between said inner and outer faces, said platelike member having a first bearing surface formed thereon which is positioned adjacent one edge of said opening and faces away from said inner face;

a second member having a locking portion thereof insertable into said opening from said inner face, said locking portion having a second bearing surface which faces and is disposed in engagement with said first bearing surface when said first and second members are coupled together; and locking means for holding said first and second bearing surfaces in contact with one another to prevent separation of said first and second members, said locking means comprising a locking member forming a part of and being movably supported on said first platelike member for movement relative to said first member in respective opposite directions between (1) a non-locking position wherein said locking member is removed from said opening and is disposed at least partially outwardly from said outer face and (2) a locking position wherein said locking member is disposed within said opening and retains said first and second bearing surfaces in engagement with one another to prevent separation of said first and second members until said locking member is moved manually from said locking to said non-locking position.

11. A coupling according to claim 10, wherein the locking portion of said second member when disposed within said opening does not project outwardly beyond said outer face, and wherein said locking member when disposed in said locking position is substantially flush with said outer face.

12. A coupling according to claim 10, wherein said second member comprises an elongated postlike element which extends transverse with respect to said inner face, said element having a free end part which defines said locking portion, said free end part including a sidewardly extending projection having a lower face which defines said second bearing surface.

13. A coupling according of claim 12, wherein said second member includes a platelike element disposed opposite said first platelike member, said postlike element being mounted on and extending transversely from said platelike element toward said first platelike member.

* * * * *